US005340088A

United States Patent [19]

Madritsch et al.

[11] Patent Number: 5,340,088

[45] Date of Patent: Aug. 23, 1994

[54] METALLURGICAL VESSEL AND METHOD OF MAKING THE REFRACTORY LINING OF SUCH VESSELS

[75] Inventors: Gerhard Madritsch, Vienna; Bruno Hirschberg, Vienna; Friedrich Kassegger, Vienna; Heinz Maslo, Baden; Paul Weitzer, Vienna, all of Austria

[73] Assignee: Veitscher Magnesitwerke-Actien-Gesellschaft, Vienna, Austria

[21] Appl. No.: 113,735

[22] Filed: Aug. 30, 1993

Related U.S. Application Data

[63] Continuation of Ser. No. 778,119, Dec. 9, 1991, abandoned.

[30] Foreign Application Priority Data

Apr. 12, 1990 [AT] Austria ..... 881/90

[51] Int. Cl.[5] ..... C21C 5/44

[52] U.S. Cl. ..... 266/44; 266/275; 266/280; 266/281; 264/30

[58] Field of Search ..... 266/275, 280, 281, 44, 266/286; 264/30

[56] References Cited

U.S. PATENT DOCUMENTS

| | | | |
|---|---|---|---|
| 4,455,014 | 6/1984 | Genies | 266/286 |
| 4,469,309 | 9/1984 | Takashima et al. | 266/280 |
| 4,993,692 | 2/1991 | Brown et al. | 266/275 |

FOREIGN PATENT DOCUMENTS

| | | |
|---|---|---|
| 0374499 | 9/1983 | Austria . |
| 0064863 | 11/1982 | European Pat. Off. . |
| 0249959 | 12/1987 | European Pat. Off. . |
| 0318701 | 6/1989 | European Pat. Off. . |
| 2438928 | 2/1975 | Fed. Rep. of Germany . |
| 2843735 | 4/1979 | Fed. Rep. of Germany . |
| 2852248 | 6/1980 | Fed. Rep. of Germany . |
| 2105828 | 9/1981 | United Kingdom . |

*Primary Examiner*—Scott Kastler

*Attorney, Agent, or Firm*—John F. A. Earley; John F. A. Earley, III

[57] ABSTRACT

The invention relates to a metallurgical vessel, in particular a transport ladle or a treating ladle, for the production of steel with a bottom (2b) having a refractory lining (3) with a basic working layer (5). In order to create a durable lining it is provided that the working layer (5) consists at least in part of dry basic bulk material, the upper side of which is covered, before the vessel (1) is heated for the first time, by a chemically hardened protective layer (6) and which, after the vessel (1) has been filled, is partly present as a monolithic layer or the upper side of the working layer (5) is covered, before the vessel (1) is charged for the first time, by a monolithically fritted basic layer formed by heating the bulk material. The invention furthermore relates to a method of making the refractory linings of such vessels.

15 Claims, 2 Drawing Sheets

METALLURGICAL VESSEL AND METHOD OF MAKING THE REFRACTORY LINING OF SUCH VESSELS

This is a continuation of copending application(s) Ser. No. 07/778,119 filed on Dec. 9, 1991, now abandoned.

The invention relates to a metallurgical vessel, in particular a transport ladle or a treating ladle, for the production of steel with a bottom having a refractory lining with a basic working layer.

The linings of metallurgical vessels for the production of steel, which are mainly linings of electric furnaces, pig-iron transport ladles, steel transport ladles or steel treating ladles, are increasingly built with basic bricks, as determined by the metallurgical processes and the chemical properties of steel and steel slag.

It is usual to build such linings with bricks made from magnesite or dolomite which are bonded by pitch or synthetic resin or otherwise chemically bonded, or which are burned bricks. For many years efforts have been made to replace such bricks by mixes made from magnesite or dolomite in order to avoid the expensive production of such bricks and the work caused by laying the bricks. All developments of such basic mixes have aimed towards adding bonding agents to the sintered magnesite or sintered dolomite which bonding agents are to be activated by water, these mixes hardening after the processing to form a monolithic lining. These efforts have proved to be uneconomical.

Such monolithic basic linings chemically bonding at ambient temperature, are rigid throughout the thickness of the lining. Cracks occur during heating, through which liquid steel can penetrate deeply and thus destroy the lining over large areas.

Furthermore, in common bonding systems the chemical bonding is often activated by the addition of water. This water, however, cannot completely be removed after hardening and drying of the lining, which also leads to the formation of large cracks during heating. Water leads to hydration, particularly in dolomitic materials, which causes the loss of the refractory properties.

Furthermore, linings consisting of dry basic bulk material are known for horizontal linings in bottoms of electric furnaces. In such a vessel, there is often not the problem that the bulk material is flushed away by the stream of liquid steel during the first charging of the vessel. If such liquid steel is added to the charge, the bulk material on the bottom is be covered by cold scrap and thus protected.

In vessels, however, where the stream of steel hits the bottom lining in free descent, in particular in steel transport ladles or treating ladles, there is indeed the problem that during the first charging of the vessel the bulk material is flushed away by the first stream of liquid steel.

It is the object of the present invention to provide a lining for the bottom of such a vessel which can be easily and inexpensively applied and which ensures the safe use thereof.

According to the invention it is therefore provided that the working layer consists at least in part of dry basic bulk material, the upper side of which is covered, before the vessel is heated for the first time, by a chemically hardened protective layer and which, after the vessel has been filled, is partly present as a monolithic layer.

The working layer is defined herein as the main layer of the bottom lining which comes into contact with liquid steel and which, apart from wear, remains permanently in the vessel. The lining further comprises a protective layer. The working layer is introduced into the vessel as dry bulk material, that is to say, it is essentially free from water. The bulk material may, however, nevertheless be soaked with oil, bitumen, synthetic resin, and the like, for instance in order to facilitate the moulding or to reduce the formation of dust. The initial heating of the vessel either takes place by the first charging with liquid steel or by an own step where the lining, after having been applied, is heated up to the approximate processing temperature by means of burners.

Sintered magnesite or dolomite frit completely under the influence of temperatures from approximately 1200° C. upwards and form a consolidated layer. The temperature of liquid steel is sufficient for such ceramic consolidation up to a layer depth of 40 to 60 mm. Such a ceramically bonded layer developed under the influence of temperature after charging of steel, forms a supporting monolithic bottom layer, which, during operation, continuously wears off on the side of the steel bath, but continues to build itself up on the cold side in direction to the ladle bottom. The expansion of the ceramic layer due to fluctuations in temperature during charging and emptying of the ladle is absorbed by the bulk material lying on the cold side and being not yet ceramically bonded, so that coarse cracks do not come about in the ceramic layer.

In a thin, ceramically bonded flexible layer it might happen that fine cracks occur on fluctuations in temperature. If liquid steel should penetrate such cracks, it disperses among the bulk material located on the cold side.

The protective layer serves to prevent the flushing away of the lining during the first charging of the vessel.

According to an embodiment of the invention, the working layer consists at least in part of dry basic bulk material, the upper side of which is covered, before the vessel is charged for the first time, by a monolithically fritted basic layer formed by heating the bulk material. The lining is protected from flushing in that the introduced bulk material is heated by burners. This leads to a monolithic fritted layer on the surface.

Preferably, an insulating layer is provided between the bottom of the vessel and the basic refractory working layer. This insulating layer may consist of sprayed material, preferably of fire-clay or high alumina material, which is hardened at ambient temperature.

The bottom lining of the vessel can be provided with various inserts, such as well blocks, baffle plates or nozzles, which are rigidly attached to the bottom of the vessel or the insulating layer. It is often necessary that a metallurgical vessel is tilted. This leads to the danger that the relatively thin fritted working layer is not able to hold a heavy well block or the like. This problem can be avoided by embedding in the insulating layer or by other fastening to the vessel bottom.

The baffle plate embedded in the working layer is preferably cast from a material which chemically sets at ambient temperature. The baffle plate resists the attack of the stream of liquid steel. The bulk material adjacent to the inserts is protected by the protective layer against flushing away.

It is particularly preferable if the inserts comprise an offset in the zone of the protective layer. This leads to a particularly good connection.

It may be further provided that the inserts comprise inclined lateral walls, so that the cross section changes with increasing wear. This measure leads to the effect that the continuously formed sintering layer sits close to the inserts. The best angle $\alpha$ for achieving this purpose is determined in each case by trials.

The bulk material forming the working layer may, for example, consist of sintered magnesite, preferably with an increased content of lime of more than 7 percent CaO, sintered dolomite, or mixtures of sintered magnesite and sintered dolomite with chrome ore or corundum. It has proved to be particularly beneficial if sintering agents, such as iron oxide, boric acid, boron compounds, dry water glass, or micro powder from metal oxides, are added to the bulk material forming the working layer.

The invention further relates to a method of making the refractory lining for the bottom of metallurgical vessels for steel production.

This method is characterized by the following steps:

Applying a layer of dry basic refractory bulk material on the bottom of the vessel and/or on the insulating layer;

preferably compacting the bulk material by vibrating, shaking or ramming;

applying a protective layer on the bulk material, said layer consisting of a mix hardening by chemical bonding;

drying and hardening of the refractory material;

heating the lining.

The heating of the lining takes place either by introducing burners or, if such a step is not provided, by the first steel bath itself.

An embodiment of the method is characterized by the following steps:

Applying a layer of dry basic refractory bulk material on the bottom of the vessel and/or on the insulating layer;

preferably compacting the bulk material by vibrating, shaking or ramming;

heating the lining by introducing burners.

It is preferable if a material is selected which ceramically bonds under the influence of the temperature of the steel bath and which conveys the temperature to the bulk material in such a way that this one frits and hardens on the side adjacent to the steel bath.

The inner layers of the bulk material can be enriched with sintering agents.

BRIEF DESCRIPTION OF THE DRAWINGS

The invention is outlined more in detail by reference to the drawings wherein.

Figure 1:
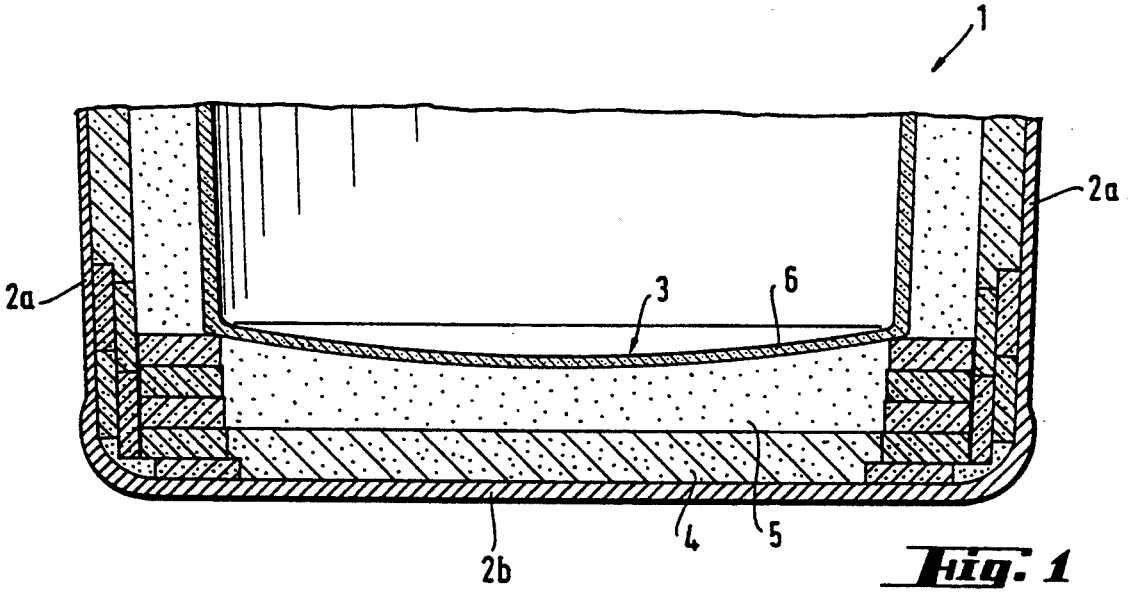
FIG. 1 shows a section through a metallurgical vessel according to the invention.

A metallurgical vessel 1 consists of side walls 2a and a bottom 2b. The bottom 2b is provided with a lining 3 having an outer insulating layer 4, a working layer 5 made from refractory basic material, and a protective layer 6.

Figure 2:
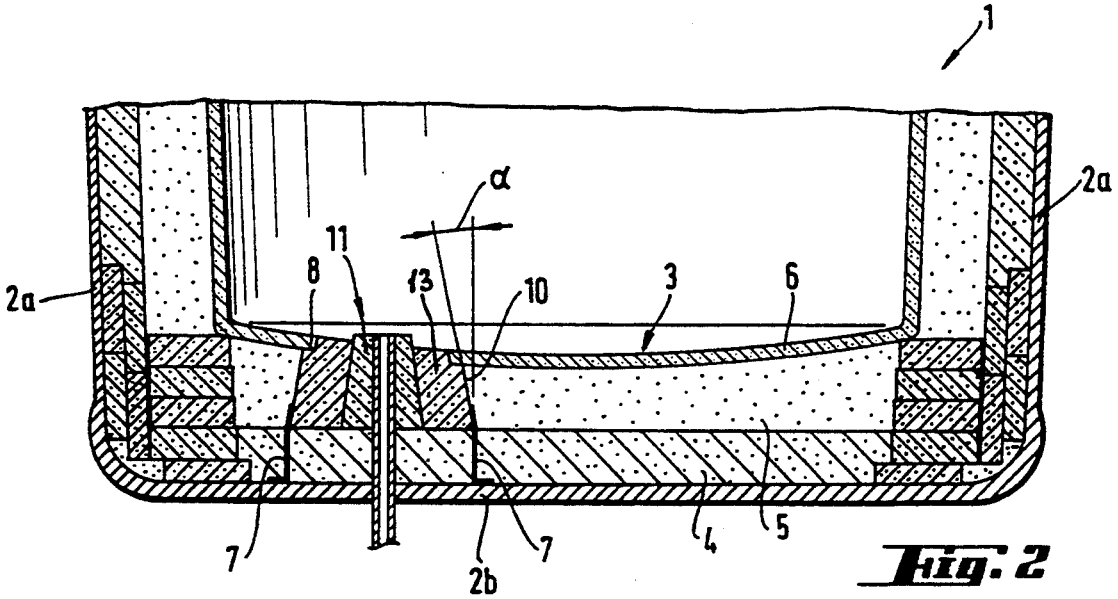
FIG. 2 shows a section through another embodiment of the invention.

In the embodiment of FIG. 2, a nozzle 11 is arranged in the bottom lining 3, the nozzle 11 being seated in a well block 13. The lateral walls 10 of the well block 13 are inclined at an angle $\alpha$. In the area of the protective layer 6 an offset 8 is provided on the well block 13. The well block 13 is further attached to bottom 2b by means of armature iron 7.

Figure 3:
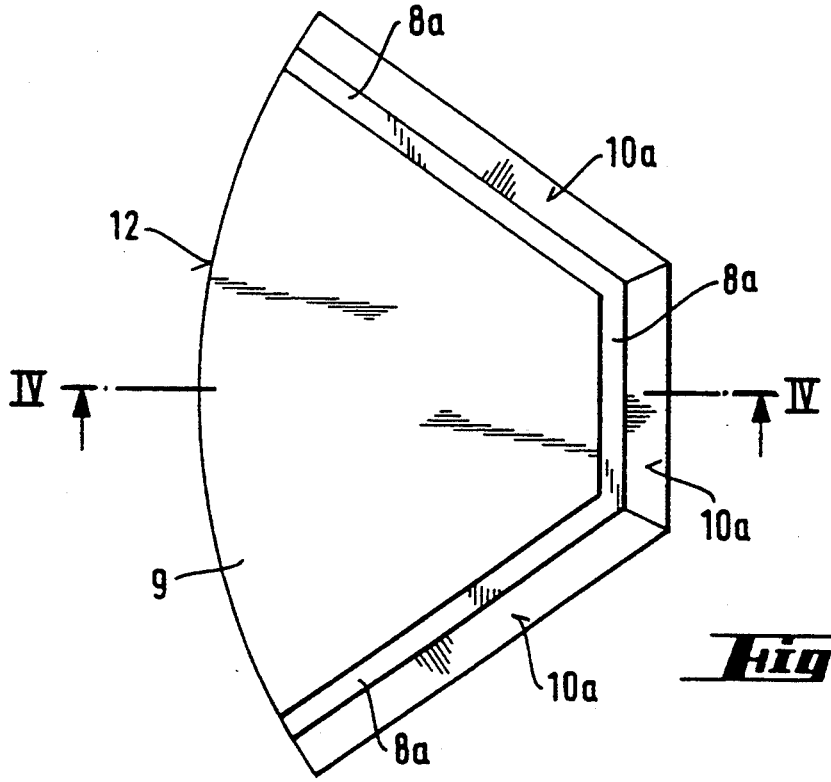
FIG. 3 shows a view of a baffle plate.
Figure 4:
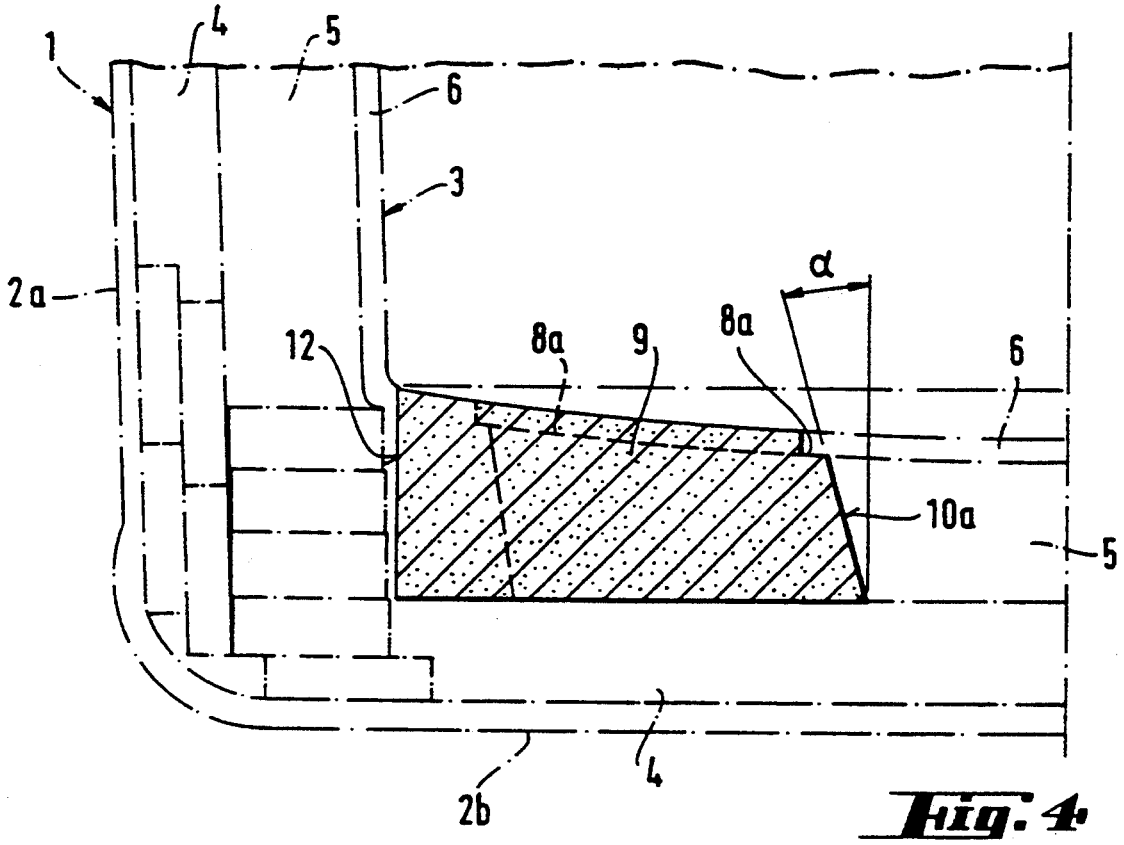
FIG. 4 shows the baffle plate in a section along line IV—IV of FIG. 3 and its arrangement in a metallurgical vessel.

The baffle plate 9 of FIGS. 3 and 4 comprises lateral walls 10a which are inclined at an angle $\alpha$ as well as an offset 8a for the anchoring of the protective layer 6. The edge 12 of the baffle plate 9 is bent, because the baffle plate 9 is placed on the side wall 2a of the vessel 1.

We claim:

1. Bottom for a metallurgical vessel for the production of steel having a refractory lining with a basic working layer comprising at least in part of a granular, nonmonolithic dry basic bulk material before a first charging of molten metal occurs, the upper side of the working layer being covered by a chemically hardened protective layer, and, after the vessel has been filled with molten metal, the working layer being partly present as a monolithic layer formed from the bulk material.

2. Bottom according to claim 1, wherein an insulating layer is provided between the bottom of the vessel and the basic refractory working layer.

3. Bottom according to claim 2, wherein the insulating layer consists of sprayed material, which is hardened at ambient temperature.

4. Bottom according to claim 2, wherein the bottom lining of the vessel is provided with inserts, including well blocks, baffle plates or nozzles, which are rigidly attached to the bottom of the vessel or the insulating layer (4).

5. Bottom according to claim 4, wherein the inserts comprise an offset in the zone of the protective layer.

6. Bottom according claim 4, wherein the inserts comprise inclined lateral walls, so that the cross section changes with increasing wear.

7. Bottom according to claim 1, wherein the bulk material forming the working layer consists of sintered magnesite, sintered dolomite, or mixtures of sintered magnesite and sintered dolomite with chrome ore or corundum.

8. Bottom according to any of claim 1, wherein sintering agents are added to the bulk material forming the working layer.

9. Method of making a refractory lining for a bottom of metallurgical vessels (1) for steel production, including the following steps:

Applying a layer of a granular, non-monolithic dry basic refractory bulk material on the bottom of the vessel or on an insulating layer provided on said bottom;

compacting the bulk material by vibrating, shaking or ramming;

applying a protective layer on the bulk material, said layer consisting of a mix hardening by chemical bonding;

drying and hardening the refractory material; and charging the vessel with molten metal to form part of the bulk material as a monolithic layer.

10. Method according to claim 9 wherein a material is selected which ceramically bonds under the influence of the temperature of a steel bath and which conveys the temperature to the bulk material in such a way that this one frits and hardens on the side adjacent to the steel bath.

11. Method according to claim 9, wherein the heating of the vessel takes place by introducing burners before the charging with a steel bath.

12. Method in acccordance with claim 9, wherein the inner layers of the bulk material are enriched with sintering agents.

13. Bottom according to claim 3, wherein the insulating layer consists of fire-clay or high alumina material.

14. The bottom of claim 7, wherein the sintered magnesite has a CaO content of more than 7 percent.

15. The bottom of claim 8, wherein the sintering agents comprise iron oxide, boric acid, boron compounds, dry water glass or micro powder from metal oxides.

* * * * *